US010415440B2

(12) United States Patent
Lian et al.

(10) Patent No.: US 10,415,440 B2
(45) Date of Patent: Sep. 17, 2019

(54) CONTINUOUSLY VARIABLE VALVE LIFT SYSTEM AND AUTOMOBILE

(71) Applicant: Guangzhou Automobile Group Co., Ltd., Guangzhou, Guangdong Province (CN)

(72) Inventors: Hainian Lian, Guangzhou (CN); Jujiang Liu, Guangzhou (CN); Liang Chen, Guangzhou (CN); Yuhuai Li, Guangzhou (CN); Zonglan Zhang, Guangzhou (CN); Zhen Lu, Guangzhou (CN)

(73) Assignee: GUANGZHOU AUTOMOBILE GROUP CO., LTD., Guangzhou, Guangdong Province (CN)

( * ) Notice: Subject to any disclaimer, the term of this patent is extended or adjusted under 35 U.S.C. 154(b) by 23 days.

(21) Appl. No.: 15/752,551

(22) PCT Filed: Oct. 14, 2016

(86) PCT No.: PCT/CN2016/102104
§ 371 (c)(1),
(2) Date: Feb. 13, 2018

(87) PCT Pub. No.: WO2017/101578
PCT Pub. Date: Jun. 22, 2017

(65) Prior Publication Data

US 2019/0024542 A1 Jan. 24, 2019

(30) Foreign Application Priority Data

Dec. 17, 2015 (CN) ..... 2015 1 0964417

(51) Int. Cl.
*F01L 1/18* (2006.01)
*F01L 13/00* (2006.01)
*F01L 1/14* (2006.01)

(52) U.S. Cl.
CPC ..... *F01L 13/0031* (2013.01); *F01L 1/143* (2013.01); *F01L 1/185* (2013.01); *F01L 13/00* (2013.01)

(58) Field of Classification Search
CPC . F01L 1/143; F01L 1/185; F01L 13/00; F01L 13/0031
(Continued)

(56) References Cited

U.S. PATENT DOCUMENTS 6,422,187 B2 7/2002 Fischer et al.
7,314,029 B2 * 1/2008 Hiraiwa ..... F01L 13/0063 123/90.16
(Continued)

FOREIGN PATENT DOCUMENTS

CN 1690372 A 11/2005
CN 1696477 A 11/2005
(Continued)

*Primary Examiner* — Ching Chang
(74) *Attorney, Agent, or Firm* — Cheng-Ju Chiang

(57) ABSTRACT

A continuously variable valve lift system includes a driving swing arm, a camshaft, a valve structure, a control shaft and an adjusting swing arm. The valve structure includes a roller rocker arm and a valve connected to the roller rocker arm. The driving swing arm has a driving arc surface. The driving arc surface contacts with the roller rocker arm to drive the valve to perform a reciprocating movement. The driving swing arm is sleeved on the control shaft and is capable of swinging around the control shaft. The control shaft is provided with a mounting part. The adjusting swing arm is connected to the mounting part and is capable of swinging relative to the mounting part. The adjusting swing arm is disposed between the camshaft and the driving swing arm. Two sides of the adjusting swing arm are contacted respectively with the camshaft and the driving swing arm.

10 Claims, 4 Drawing Sheets

(58) Field of Classification Search
USPC ..... 123/90.16, 90.39, 90.44
See application file for complete search history.

(56) References Cited

U.S. PATENT DOCUMENTS

| | | | |
|---|---|---|---|
| 2007/0022989 | A1 | 2/2007 | Meyer et al. |
| 2010/0122677 | A1 | 5/2010 | Lee et al. |
| 2010/0139588 | A1 | 6/2010 | Kim et al. |

FOREIGN PATENT DOCUMENTS

| | | | |
|---|---|---|---|
| CN | 101539041 | A | 9/2009 |
| CN | 101550853 | A | 10/2009 |
| CN | 101705851 | A | 5/2010 |
| CN | 102155273 | A | 8/2011 |
| CN | 103670579 | A | 3/2014 |
| CN | 104373169 | A | 2/2015 |
| CN | 105507979 | A | 4/2016 |
| JP | 4205595 | B2 | 1/2009 |
| JP | 4210589 | B2 | 1/2009 |

* cited by examiner

CONTINUOUSLY VARIABLE VALVE LIFT SYSTEM AND AUTOMOBILE

CROSS REFERENCE TO RELATED APPLICATIONS

This application is a 35 U.S.C. § 371 National Phase conversion of International (PCT) Patent Application No. PCT/CN2016/102104, filed on Oct. 14, 2016, which claims the priority of Chinese Patent Application No. 201510964417.4, filed on Dec. 17, 2015. The contents of the above-identified applications are incorporated herein by reference. The PCT International Patent Application was filed and published in Chinese.

TECHNICAL FIELD

The present application relates to an engine of an automobile, and particularly to a continuously variable valve lift system and an automobile having the same.

BACKGROUND

During operation of reciprocating internal combustion engine, the valve can be opened and closed regularly through the valve driving mechanism, such that the engine can effectively absorb fresh air or combustible mixture, and can discharge the exhaust gas from the cylinder. After a valve driving mechanism is designed, movement of the valve is fixed. Valve lift and duration of valve opening cannot be adjusted according to actual operations of the engine.

The engine of automobile is running in all conditions. In design, it is necessary to take into account both power in high load and economy in low load. However, the fixed movement of the valve endows the engine a best state only in a particular working condition. It is unable to reconcile the demands of power and economy in most cases for the engine.

In order to overcome such defect of the engine, variable valve lift systems are increasingly used in engines. However, existing variable valve lift systems are complex in structure and difficult to manufacture, and the duration of valve opening cannot be adjusted.

SUMMARY

In view of the above, the present application provides a continuously variable valve lift system and an automobile having the same, which has a simple structure, and the valve lift and the duration of valve opening can be adjusted.

The present application provides a continuously variable valve lift system. The continuously variable valve lift system includes a driving swing arm, a camshaft and a valve structure. The valve structure includes a roller rocker arm and a valve connected to the roller rocker arm. The driving swing arm has a driving arc surface. The driving arc surface contacts with the roller rocker arm to drive the valve to move in a reciprocating manner. The continuously variable valve lift system further includes a control shaft and an adjusting swing arm. The driving swing arm is sleeved on the control shaft and is capable of swinging around the control shaft. The control shaft is provided with a mounting part. The adjusting swing arm is connected to the mounting part and is capable of swinging relative to the mounting part. The adjusting swing arm is disposed between the camshaft and the driving swing arm, and two sides of the adjusting swing arm are contacted respectively with the camshaft and the driving swing arm.

Further, the continuously variable valve lift system further comprises a torsion spring, one end of the torsion spring is adapted to be fixed to a casing of an engine, and the other end of the torsion spring is fixed to the driving swing arm.

Further, a rotation axle is mounted on the mounting part, the adjusting swing arm is connected to the rotation axle to cause the adjusting swing arm to be capable of swinging around the rotation axle.

Further, the driving arc surface is provided with a blanking segment and a driving segment, the blanking segment is an arc segment which takes the control shaft as its center.

Further, a top of the driving swing arm is provided with a circular ring, the circular ring is sleeved on the control shaft.

Further, a groove is provided in the circular ring, the mounting part is received in the groove and extends outwardly from the groove.

Further, the driving swing arm is provided with a first contact surface which faces to the adjusting swing arm, the adjusting swing arm is provided with a second contact surface which faces to the driving swing arm, the first contact surface contacts with the second contact surface.

Further, the adjusting swing arm is provided with a roller, the camshaft is provided with a cam, the cam forms a rolling friction contact with the roller.

Further, the cam, the adjusting swing arm, the driving swing arm and the valve structure each have two in quantity, and each cam, each adjusting swing arm, each driving swing arm and each valve structure are correspondingly disposed to constitute a valve adjusting system.

The present application further provides an automobile, and the automobile has the above-mentioned continuously variable valve lift system.

In conclusion, the continuously variable valve lift system provided by the embodiment of the present application has a simple structure. The mounting part is provided on the control shaft, and the adjusting swing arm is connected to the mounting part. The adjusting swing arm is driven to move upward and downward by rotating the control shaft, and the adjusting swing arm pushes the driving swing arm to rotate at a certain extent, to change the contact position between the roller rocker arm and the driving arc surface, such that the valve lift and the duration of valve opening are adjusted. Thus, the engine can adopt different valve lifts in high load areas and in low load areas, to reconcile the demands of power and economy.

The above contents are only an overview of the technical solution of the present application. In order to make the technical solution of the present application more clearly such that it can be carried out according to the description of the specification, and to make the purposes, characteristics and advantages of the present application more apparently, the present application will now be described specifically with reference to the following preferred embodiments when taken in conjunction with the accompanying drawings.

DETAILED DESCRIPTION OF PREFERRED EMBODIMENTS

Figure 1:
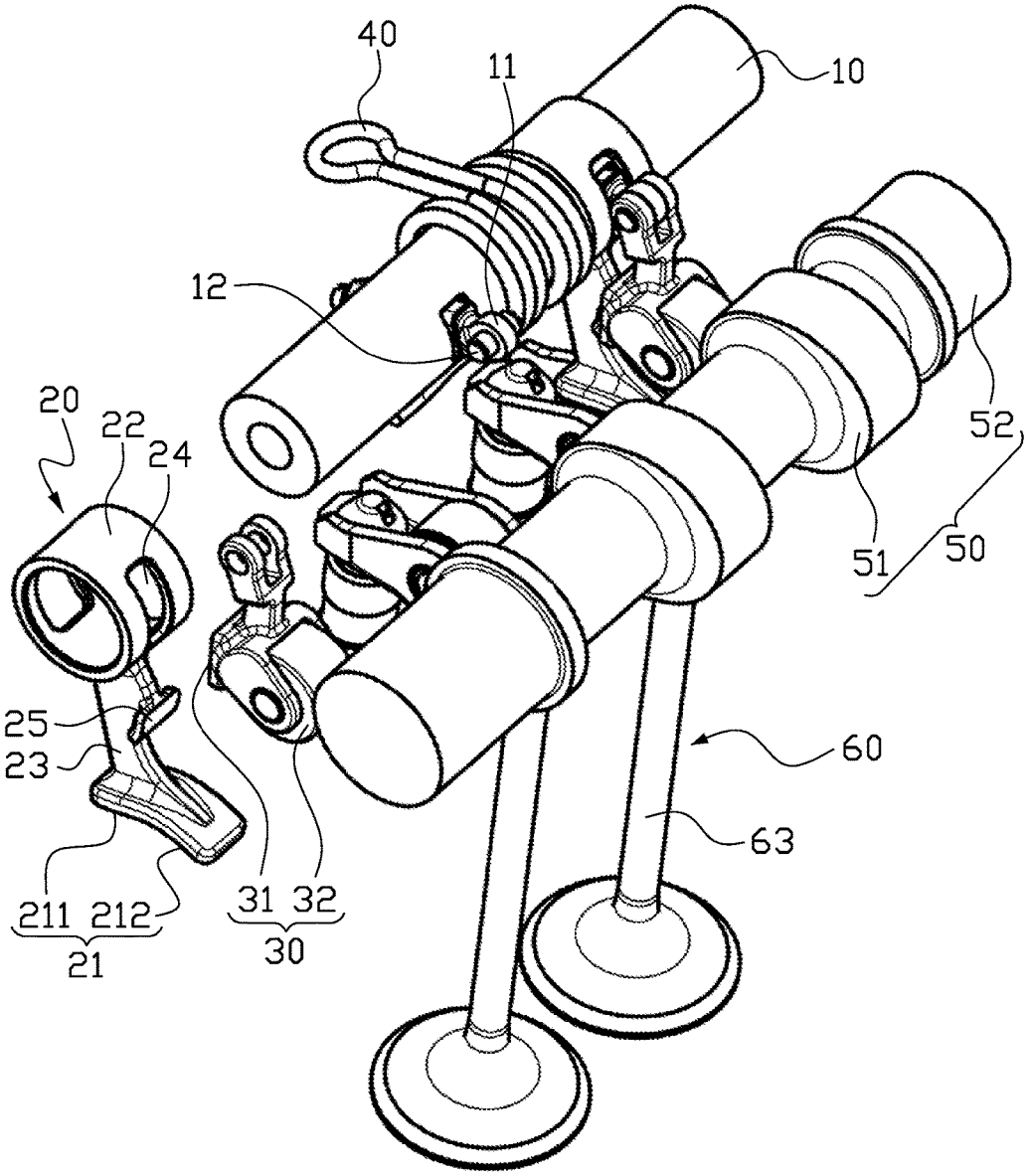
FIG. 1 is an isometric view of a continuously variable valve lift system provided according to an embodiment of the present application.
Figure 2:
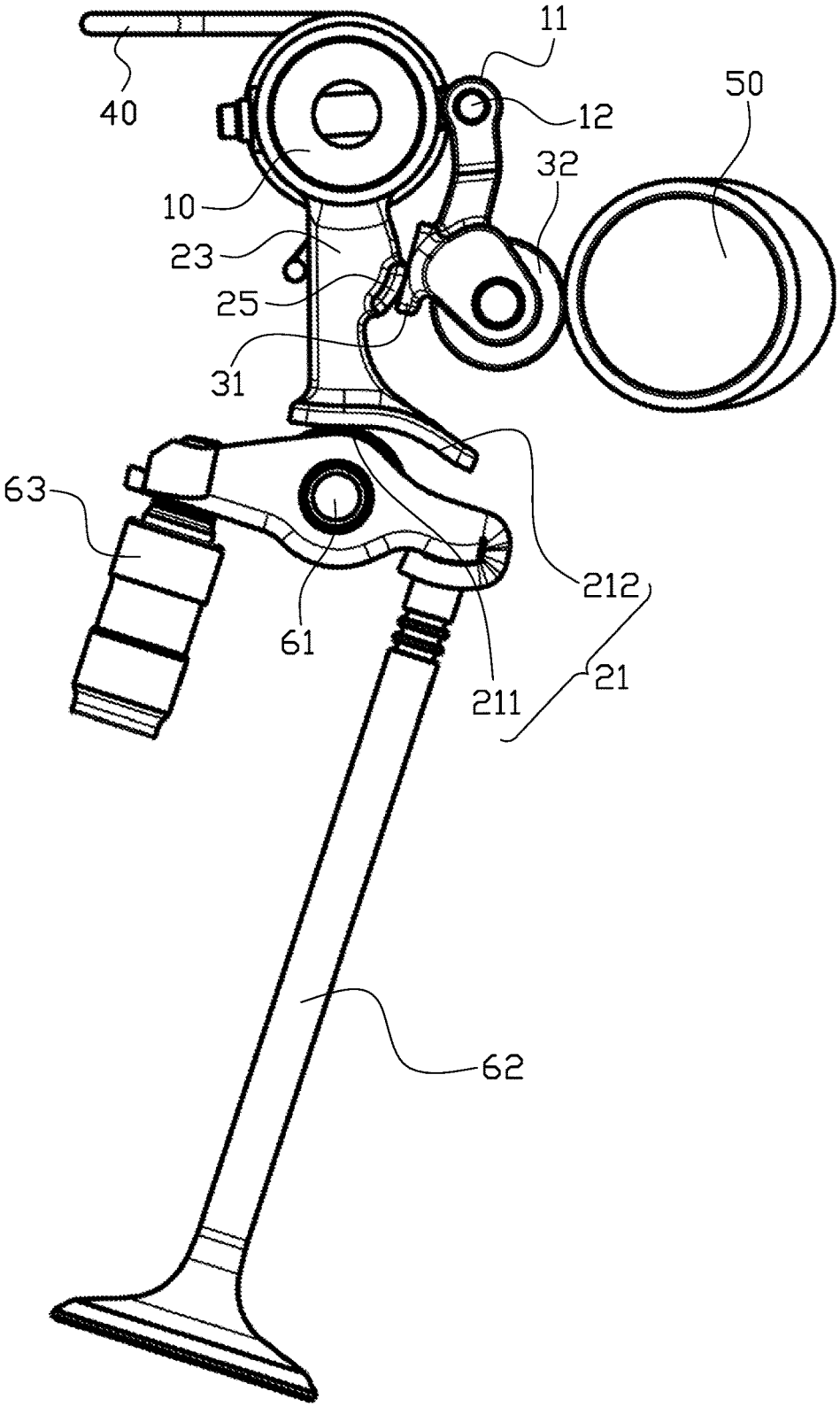
FIG. 2 is a side view of the continuously variable valve lift system of FIG. 1.

In order to further describe the technical solutions and effects of the present application for achieving the intended purposes, the present application will now be described specifically with reference to the following preferred embodiments when taken in conjunction with the accompanying drawings The present application provides a continuously variable valve lift system. FIG. 1 is an isometric view of a continuously variable valve lift system provided according to an embodiment of the present application. FIG. 2 is a side view of the continuously variable valve lift system of FIG. 1. As shown in FIGS. 1-2, the continuously variable valve lift system includes a control shaft 10, a driving swing arm 20, an adjusting swing arm 30, a torsion spring 40, a camshaft 50, and a valve structure 60. The valve structure 60 includes a roller rocker arm 61 and a valve 62 connected to the roller rocker arm 61.

The driving swing arm 20 is sleeved on the control shaft 10 and is capable of swinging around the control shaft 10. In the embodiment, a top of the driving swing arm 20 is provided with a circular ring 22 which is sleeved on the control shaft 10, to cause the driving swing arm 20 to be capable of rotating around the control shaft 10. In the middle position of the driving swing arm 20, there is provided with a first contact surface 25 which faces to the adjusting swing arm 30. The first contact surface 25 can be a circular arc surface. A driving arc surface 21 is provided at the bottom of the driving swing arm 20 for driving the valve structure 60. There is an arc segment formed at the left side of the driving arc surface 21, and the left-side arc segment takes the control shaft 10 as its center to form as a blanking segment 211. A driving segment 212 is formed at the right side of the driving arc surface 21 for driving the roller rocker arm 61. The driving arc surface 21 contacts with the roller rocker arm 61.

The control shaft 10 is provided with a mounting part 11. The mounting part 11 is fixed on the control shaft 10. The adjusting swing arm 30 is connected to the mounting part 11 and is capable of swinging relative to the mounting part 11. In the embodiment, a rotation axle 12 is mounted on the mounting part 11, and a top of the adjusting swing arm 30 is connected to the rotation axle 12, to cause the adjusting swing arm 30 to be capable of swinging around the rotation axle 12. The adjusting swing arm 30 is disposed between the camshaft 50 and the driving swing arm 20, and two sides of the adjusting swing arm 30 are contacted respectively with the camshaft 50 and the driving swing arm 20. Particularly, at the bottom of the adjusting swing arm 30, there is provided with a second contact surface 31 which faces to the driving swing arm 20. The second contact surface 31 may be a sloping surface. The second contact surface 31 of the adjusting swing arm 30 contacts with the first contact surface 25 of the driving swing arm 20. A roller 32 is further provided at the bottom of the adjusting swing arm 30. The roller 32 is configured to contact with the camshaft 50.

The camshaft 50 and the control shaft 10 are arranged in parallel. A cam 51 is provided on the camshaft 50. The cam 51 forms a rolling friction contact with the roller 32 of the adjusting swing arm 30. By the adjusting swing arm 30, the camshaft 50 can drive the driving swing arm 20 to swing around the control shaft 10.

The torsion spring 40 is mounted on the control shaft 10, one end of the torsion spring 40 is fixed to a casing of the engine, and the other end of the torsion spring 40 is fixed to the driving swing arm 20. The torsion spring 40 is configured to assist the driving swing arm 20 to restore, to ensure the driving swing arm 20 is always in contact with the adjusting swing arm 30.

When the continuously variable valve lift system provided by the embodiment of the present application is used to control the opening and closing of the valve 62, the cam 51 of the camshaft 50 drives the roller 32 of the adjusting swing arm 30 to cause the adjusting swing arm 30 to swing around the mounting part 11 of the control shaft 10. Meanwhile, due to the contact between the second contact surface 31 of the adjusting swing arm 30 and the first contact surface 25 of the driving swing arm 20, the adjusting swing arm 30 drives the driving swing arm 20 to cause the driving swing arm 20 to swing around the control shaft 10. As the driving swing arm 20 swings, the valve 62 is pushed to move upward and downward in a reciprocating manner due to the contact between the driving arc surface 21 and the roller rocker arm 61. When the roller rocker arm 61 slides along the blanking segment 211 of the driving arc surface 21, the valve 62 is closed; when the roller rocker arm 61 slides along the driving segment 212 of the driving arc surface 21, the valve 62 is opened.

The torsion spring 40 is mounted on the control shaft 10, one end of the torsion spring 40 is fixed to the casing of the engine, and the other end of the torsion spring 40 is fixed to the driving swing arm 20, to ensure the driving swing arm 20 is always in contact with the adjusting swing arm 30 during movement.

Figure 3:
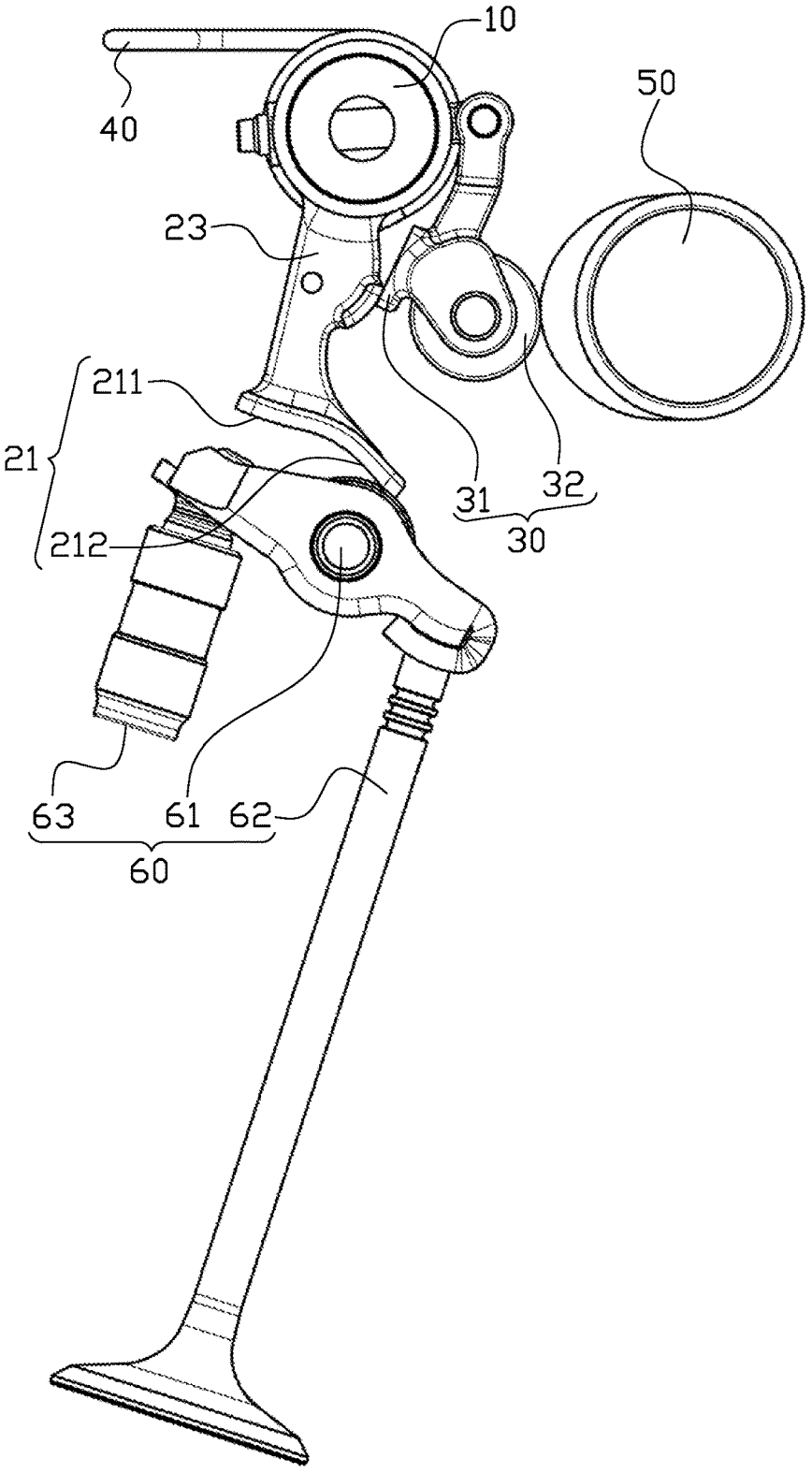
FIG. 3 is a contrasting view showing the valve lift of the continuously variable valve lift system of FIG. 1 is adjusted.

When the valve lift and the duration of valve opening of the continuously variable valve lift system provided by the embodiment of the present application are adjusted, the control shaft 10 is driven to rotate by an electric motor (not shown). Because the adjusting swing arm 30 is connected to the control shaft 10 via the rotation axle 12 and the mounting part 11, the mounting part 11 is fixed on the control shaft 10 and rotates together with the control shaft 10. Therefore, a rotation of the control shaft 10 will drive the adjusting swing arm 30 to move upward and downward. When the adjusting swing arm 30 moves upward and downward, the driving swing arm 20 is pushed to rotate at a certain extent, to thereby change the contact position between the driving arc surface 21 and the roller rocker arm 61. After the contact position between the driving arc surface 21 and the roller rocker arm 61 is changed, the contact position between the roller rocker arm 61 and the driving segment 212 of the driving arc surface 21 and the duration when the roller rocker arm 61 contacts with the blanking segment 211 of the driving arc surface 21 are both changed when the camshaft 50 rotates a circle, to realize the adjustment to the valve lift and the duration of valve opening. Specifically, when the control shaft 10 is rotated clockwise, the adjusting swing arm 30 is driven to move downward, and the driving swing arm 20 is pushed to swing rightward, to cause the valve lift to be decreased (as shown in FIG. 2); when the control shaft 10 is rotated counterclockwise, the adjusting swing arm 30 is driven to move upward, and the driving swing arm 20 is pushed to swing leftward, to cause the valve lift to be increased (as shown in FIG. 3).

Figure 4:
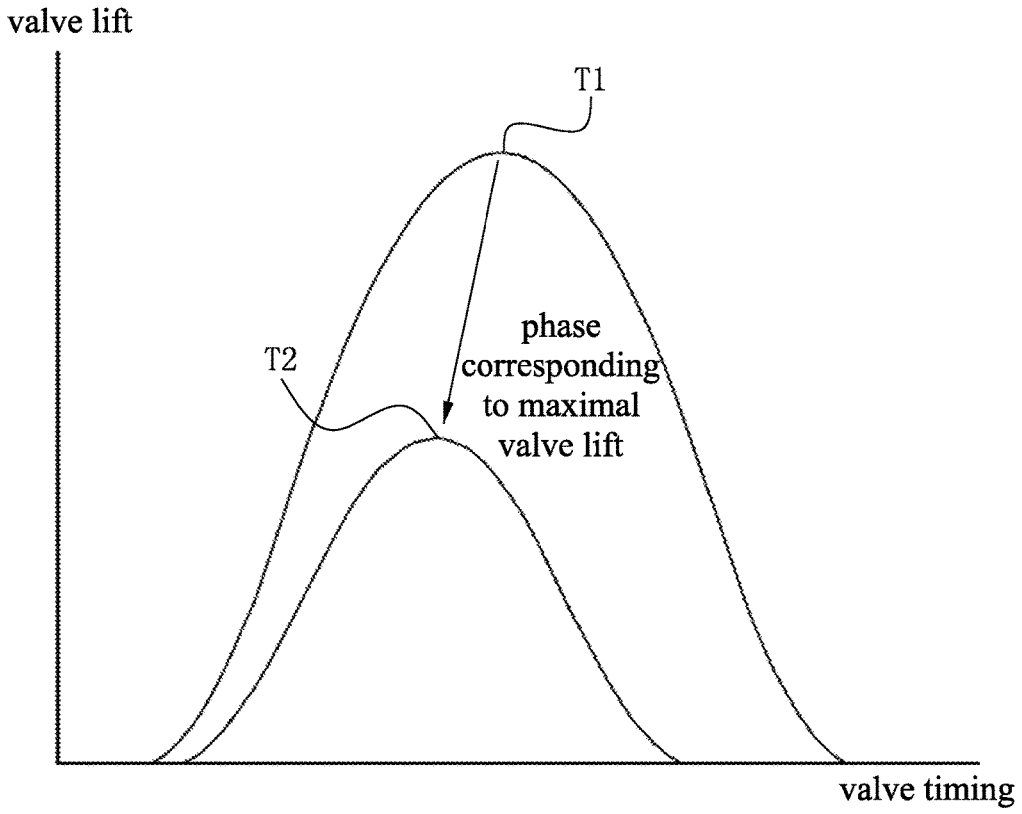
FIG. 4 is a schematic diagram showing relationship between the valve lift and the valve timing of the continuously variable valve lift system of FIG. 1.

FIG. 4 is a schematic diagram showing relationship between the valve lift and the valve timing of the continuously variable valve lift system of FIG. 1. As shown in FIG. 4, the abscissa axis denotes the valve timing, and the ordinate axis denotes the valve lift. When the ordinate value is zero, the difference of the two abscissa values represented by the valve timing is the duration of valve opening. From FIG. 4, it can be seen that, as the valve lift is adjusted to be increased, the duration of valve opening is increased. As the valve lift is adjusted to be decreased, the duration of valve opening is decreased. When the valve lift is decreased, the valve timing corresponding to the highest point of the valve lift will move forward (e.g., from T1 to T2 in FIG. 4), so that the phase corresponding to the maximal valve lift is also adjusted simultaneously, to reduce a range of movement of a phase adjuster of the engine.

Accordingly, in the continuously variable valve lift system provided by the embodiment of the present application, the valve lift, the duration of valve opening and the phase corresponding to the maximal valve lift can be adjusted continuously as the position of the adjusting swing arm 30 is adjusted. The demands of power and economy for the engine are reconciled. The maximal torque and the maximal power of the engine can be increased by using a large valve lift in high load areas, and a small valve lift can be used to control the air entering the combustion chamber in low load areas, to increase the tumble in the cylinder, optimize the combustion, reduce the loss of pumped gas and improve the fuel economy.

In addition, in order to mount the adjusting swing arm 30 corresponding to the driving swing arm 20, a groove 24 is provided in the circular ring 22 of the driving swing arm 20. The mounting part 11 of the control shaft 10 is received in the groove 24 and extends outwardly from the groove 24.

In addition, the valve structure 60 further includes a hydraulic lifter 63. The valve 62 and the hydraulic lifter 63 are disposed at two sides of the roller rocker arm 61, respectively. The hydraulic lifter 63 is configured to automatically adjust the valve interval of the valve 62.

In the embodiment, the cam 51 of the camshaft 50, the adjusting swing arm 30, the driving swing arm 20 and the valve structure 60 each have two in quantity. Each cam 51, each adjusting swing arm 30, each driving swing arm 20 and each valve structure 60 are correspondingly disposed to constitute a valve adjusting system.

The present application further provides an automobile, and the automobile has the above-mentioned continuously variable valve lift system. Other structures relating to the automobile can refer to existing technology and are herein omitted for clarity.

The continuously variable valve lift system provided by the embodiment of the present application has a simple structure. The mounting part is provided on the control shaft, and the adjusting swing arm is connected to the mounting part. The adjusting swing arm is driven to move upward and downward by rotating the control shaft, and the adjusting swing arm pushes the driving swing arm to rotate at a certain extent, to change the contact position between the roller rocker arm and the driving arc surface, such that the valve lift and the duration of valve opening are adjusted. Thus, the engine can adopt different valve lifts in high load areas and in low load areas, to reconcile the demands of power and economy.

The above are embodiments of the present application only, and should not be deemed as limitations to the present application. Although the present application has been described with preferred embodiments, it should be noted that variations and improvements will become apparent to those skilled in the art to which the present application pertains. Therefore, the scope of the present application is defined by the appended claims.

INDUSTRIAL APPLICABILITY

The continuously variable valve lift system provided by the embodiment of the present application has a simple structure. The mounting part is provided on the control shaft, and the adjusting swing arm is connected to the mounting part. The adjusting swing arm is driven to move upward and downward by rotating the control shaft, and the adjusting swing arm pushes the driving swing arm to rotate at a certain extent, to change the contact position between the roller rocker arm and the driving arc surface, such that the valve lift and the duration of valve opening are adjusted. Thus, the engine can adopt different valve lifts in high load areas and in low load areas, to reconcile the demands of power and economy.

What is claimed is:

1. A continuously variable valve lift system, comprising a driving swing arm, a camshaft and a valve structure, the valve structure comprising a roller rocker arm and a valve connected to the roller rocker arm, the driving swing arm having a driving arc surface, the driving arc surface contacting with the roller rocker arm to drive the valve to perform a reciprocating movement, wherein the continuously variable valve lift system further comprises a control shaft and an adjusting swing arm, the driving swing arm is sleeved on the control shaft and is capable of swinging around the control shaft, the control shaft is provided with a mounting part, the adjusting swing arm is connected to the mounting part and is capable of swinging relative to the mounting part, the adjusting swing arm is disposed between the camshaft and the driving swing arm, two sides of the adjusting swing arm are contacted respectively with the camshaft and the driving swing arm.

2. The continuously variable valve lift system of claim 1, wherein the continuously variable valve lift system further comprises a torsion spring, one end of the torsion spring is adapted to be fixed to a casing of an engine, and the other end of the torsion spring is fixed to the driving swing arm.

3. The continuously variable valve lift system of claim 1, wherein a rotation axle is mounted on the mounting part, the adjusting swing arm is connected to the rotation axle to cause the adjusting swing arm to be capable of swinging around the rotation axle.

4. The continuously variable valve lift system of claim 1, wherein the driving arc surface is provided with a blanking segment and a driving segment, the blanking segment is an arc segment which takes the control shaft as its center.

5. The continuously variable valve lift system of claim 1, wherein a top of the driving swing arm is provided with a circular ring, the circular ring is sleeved on the control shaft.

6. The continuously variable valve lift system of claim 5, wherein a groove is provided in the circular ring, the mounting part is received in the groove and extends outwardly from the groove.

7. The continuously variable valve lift system of claim 1, wherein the driving swing arm is provided with a first contact surface which faces to the adjusting swing arm, the adjusting swing arm is provided with a second contact surface which faces to the driving swing arm the first contact surface contacts with the second contact surface.

8. The continuously variable valve lift system of claim 1, wherein the adjusting swing arm is provided with a roller, the camshaft is provided with a cam, the cam forms a rolling friction contact with the roller.

9. The continuously variable valve lift system of claim 8, wherein the cam, the adjusting swing arm the driving swing arm and the valve structure each have two in quantity, and each cam, each adjusting swing arm, each driving swing arm and each valve structure are correspondingly disposed to constitute a valve adjusting system.

10. An automobile comprising the continuously variable valve lift system of claim 1.

* * * * *